United States Patent [19]

Koenig

[11] Patent Number: 4,584,438

[45] Date of Patent: Apr. 22, 1986

[54] PERCUSSION AIR MOTOR

[76] Inventor: Erl Koenig, Methodist Farm Rd., P.O. Box 559, Averill Park, N.Y. 12018

[21] Appl. No.: 524,195

[22] Filed: Aug. 18, 1983

Related U.S. Application Data

[63] Continuation of Ser. No. 165,962, Jul. 7, 1980, abandoned.

[51] Int. Cl.[4] ..... H04R 9/02; H04R 9/04

[52] U.S. Cl. ..... 179/115.5 DV

[58] Field of Search ..... 179/115.5 DV

[56] References Cited

U.S. PATENT DOCUMENTS

| | | | |
|---|---|---|---|
| 1,920,299 | 8/1933 | Fanger | 179/115.5 DV |
| 1,992,300 | 2/1935 | Fanger | 179/115.5 DV |
| 2,205,365 | 6/1940 | Schwaen | 179/115.5 DV |
| 2,478,642 | 8/1949 | Root | 179/120 |
| 2,520,646 | 8/1950 | Mott | 179/115 |
| 2,535,757 | 12/1950 | Root | 179/115 |
| 2,926,221 | 2/1960 | Kagdis | 179/115.5 DV |
| 3,012,107 | 12/1961 | Hanlet | 179/115.5 |
| 3,201,529 | 8/1965 | Surh | 179/115.5 DV |
| 3,686,446 | 8/1972 | Manger | 179/115.5 DV |
| 3,803,522 | 4/1974 | Rooney | 335/231 |
| 3,979,566 | 9/1976 | Willy | 179/115.5 |
| 4,004,464 | 1/1977 | Himmler | 73/462 |

FOREIGN PATENT DOCUMENTS

| | | | |
|---|---|---|---|
| 1152991 | 9/1957 | France | 179/115.5 DV |
| 55-37071 | 3/1980 | Japan | 179/115.5 DV |
| 408284 | 4/1934 | United Kingdom | 179/115.5 DV |
| 403114 | 3/1974 | U.S.S.R. | 179/115.5 DV |

*Primary Examiner*—George G. Stellar
*Attorney, Agent, or Firm*—Kenyon & Kenyon

[57] ABSTRACT

An electromechanical transducer converts an electrical signal into distortion free sound. Two equal coils are mounted on a sleeve within separate magnetic circuits. The coils are wound in identical mirror image symmetry and the magnetic circuits are disposed symmetrically of the sleeve. The application of an electric signal at the terminals of the coils causes the sleeve and diaphragm to reciprocate linearly under balanced forces within the air gap defined by the magnetic circuits.

13 Claims, 4 Drawing Figures

PERCUSSION AIR MOTOR

This is a continuation of application Ser. No. 165,962 filed July 7, 1980 now abandoned.

This invention relates to a percussion air motor. More particularly, this invention relates to a percussion air motor, such as a loudspeaker, for converting electrical signals into corresponding percussive air movements.

It is well known that transducer systems, especially of the type which convert electrical energy into mechanical energy, are inefficient in operation. Generally, only a small fraction of the total electrical energy supplied to such transducer systems is actually converted and made available as mechanical energy.

It is also well known that when the electrical energy supplied to a transducer system is in the form of a desired signal, the resulting signal in the converted energy form, will not accurately correspond to the input signal. The difference in signal content between the input and output signals is a form of distortion which is a function of the construction of the transducer system. Further, as transducers are usually operated as components in larger systems, an inefficiency in converting from one form of energy to the other will increase the distortion of the larger system. For example, an inefficient audio speaker which converts electrical energy from an amplifier into mechanical energy for creating percussive air movements, i.e., sound pressure waves, requires such large amounts of electrical energy to be delivered from an amplifier in order to achieve acceptable sound pressure levels that the distortion introduced into the overall system by the amplifier will increase.

As is known, transducers which are used as loudspeakers generally have a driving assembly for receiving an electrical signal and a diaphragm which is connected to the driving assembly to vibrate in accordance with the received signal. The driving assembly, e.g. a voice coil, usually has a coil of wire and a magnet core mounted within the coil to move in response to the magnetic field caused by the coil upon energization. In these cases, the coil is secured to the diaphragm, e.g. at a central point, while the diaphragm is hinged or the like at the outer periphery. In other cases, it has been known to have the diaphragm driven by peripheral forces. One such system is described in U.S. Pat. No. 3,979,566.

However, in this system, the diaphragm is driven in an unbalanced manner such that distortion may well result. Other similar systems are described in U.S. Pat. Nos. 3,012,107; 2,535,757 and 2,520,646. It must be noted that any improvement in the mechanical advantage of a transducer system will affect only the particular form of the available mechanical energy. In other words, in a transducer system which produces reciprocating axial mechanical motion in response to an electrical input, a variation in the mechanical advantage will cause short and forceful strokes to be exchanged for longer, but weaker ones, or vice versa. The actual work available, defined by the product of the mechanical force and the distance over which the force operates, will remain the same, signifying that a fundamental improvement in the conversion efficiency has not been achieved.

In many cases, the construction of loudspeakers have generally focused upon the diaphragm, being the element which directly couples to the air medium, as the mass of primary interest. Although the development of an effective low mass diaphragm is a worthwile design goal, advances in materials sciences and manufacturing methods have enabled the production of diaphragms which are low in weight with respect to the driving assembly. Since it is known that efficiency is related to the ratio of voice coil weight to diaphragm weight, as diaphragm weight is reduced, so must the weight of the driving coil, if efficient operation is to be retained. This is especially significant in peripherally driven transducer systems wherein the driving coils are situated at the periphery of the diaphragm, thereby having decreased the mechanical advantage with respect to the coupling of low frequency signals which are center-loaded in the diaphragm.

It becomes apparent from this analysis, that although the mechanical advantage of an electromagnetic transducer system operating at high frequencies is improved by peripheral drive, the same advantage does not hold true for low frequencies which produce maximum air pressure at a region near the center of the diaphragm, which region is furthest from the peripheral drive means. Thus, the operating efficiency of electromagnetic acoustic transducer systems at high audio frequencies which radiate along the surface of the transducer diaphragm, can be improved by producing a low mass peripheral drive system. Moreover, such reduced driving means mass will also improve the efficiency of the transducer system at low frequencies because instantaneous low frequency sound pressure waves are produced essentially by causing the diaphragm to push the air axially with the entire width of the diaphragm face. Since the pressure is maximized at the center of the diaphragm, the drive coils appear to be at one end of a radial moment arm, while the air load is at the other end.

Accordingly, it is an object of this invention to provide an electromechanical transducer system with improved energy conversion efficiency.

It is another object of this invention to provide an electromechanical transducer system which retains a high correspondence between the signal content of the respective input and output signals.

It is a further object of this invention to provide a transducer system which is economical to manufacture and simple to assemble.

It is another object of the invention to eliminate distortion in a transducer.

It is another object of this invention to provide equal but separate electro-magnetic circuits for each direction of alternating current flow.

Briefly, the invention provides a transducer, such as a loudspeaker, which is formed, in part, of a sleeve, a diaphragm secured to and within the sleeve in a central plane and electromagnetic means disposed in symmetric relation to said sleeve for reciprocating the sleeve and diaphragm in a linear manner to produce a balanced distortion free sound.

The means for reciprocating the sleeve and diaphragm includes a pair of coils wound about the sleeve in symmetrical relation about the central plane and means defining a pair of stationary magnetic circuits disposed in symmetrical relation about the central plane. The coils are equally wound to effect equal and co-directional electromagnetic forces therein in response to an alternating current supplied to the coils while each magnetic circuit is disposed about a respective one of the coils.

The arrangement of the coils and magnetic circuits relative to the sleeve and diaphragm improves low and high frequency operation of acoustic transducers by providing a peripheral drive system which contains less mass and is more efficient in converting electrical to mechanical energy than prior art systems.

By winding the coils in symmetric relation, and particularly, as mirror images of each other, an isomagnetic equilibrium is obtained at the plane of the diaphragm. The magnetic circuits are each of the type which produces magnetic lines of flux radially across an air gap in which is disposed a portion of the sleeve which contains the respectively associated coil. Energization of the coils by application of an electrical signal at the coil ends or terminals results in corresponding mechanical motion of the sleeve in a direction parallel to the central axis of the magnetic circuits.

In this construction, the transducer, i.e., loudspeaker, is able to produce sound which is distortion free as the electromotive forces imposed on the sleeve are applied symmetrically, i.e., in a balanced manner. Thus, the diaphragm is able to reciprocate, i.e., vibrate, in a balanced manner to produce a true sound wave corresponding to the electrical signal received.

Further, in this construction, the combined mass of the mirror image coil is less than the mass of a single coil required in previously known transducer systems for producing the same energy conversion efficiency. Thus, conversion efficiency is improved over prior art single coil systems having equivalent mass.

Still further, the reduced effective equivalent mass of the peripheral drive system elevates the mehanical resonant frequency of the sleeve thereby improving the ability of the sleeve to cause high frequency signals to radiate across the surface of the diaphragm. Additionally, reduced sleeve mass, with respect to a given conversion efficiency, reduces the effective moment arm at low frequencies thereby further improving the mechanical advantage and efficiency of low frequency operations.

These and other objects and advantages of the invention will become more apparent from the following detailed description and accompanying drawings in which.

Figure 1:
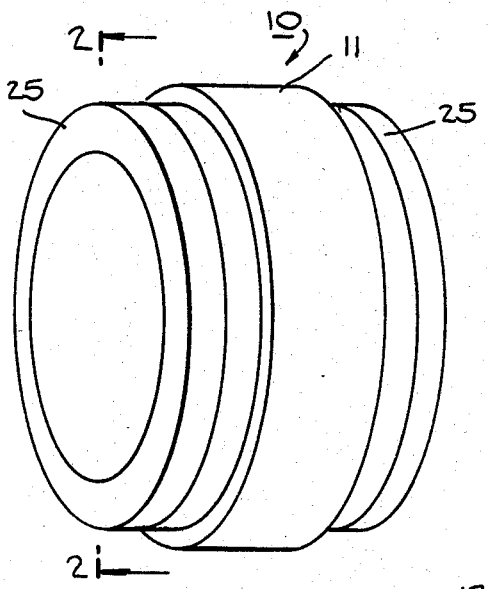
FIG. 1 is a perspective view of the transducer constructed in accordance with the invention.

Referring to FIG. 1, the transducer 10 has a generally cylindrical configurtion with open ends.

Figure 2:
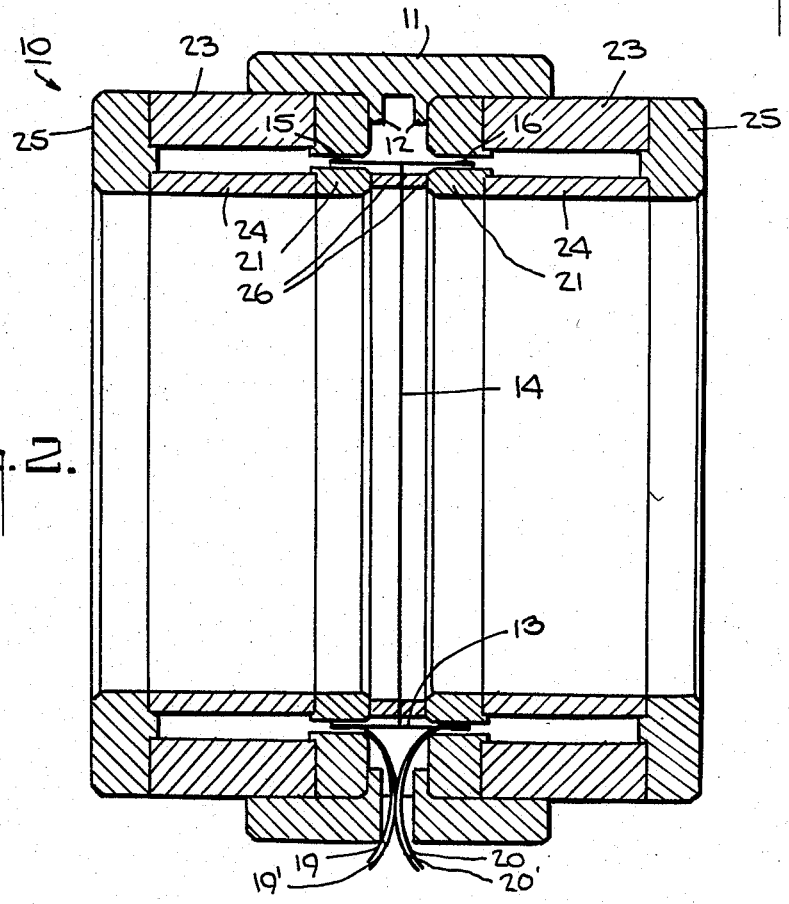
FIG. 2 is a cross-sectional view of the transducer of FIG. 1.

As shown in FIG. 2, the transducer 10 includes a central mounting frame 11 by which the transducer 10 can be mounted in a suitable housing or on a suitable support. The frame 11 is of annular shape and has a pair of inwardly directed spaced apart flanges 12. In addition, a thin-walled flangeless sleeve 13 is housed within the frame 11 and a flat disc-shaped diaphragm 14 is secured to and within the sleeve 13 in a central plane of the sleeve 13. The sleeve 13 is made of any suitable material, such as brass, while the diaphragm 14 is likewise made of a suitable material, such as metal, i.g. brass.

Figure 4:
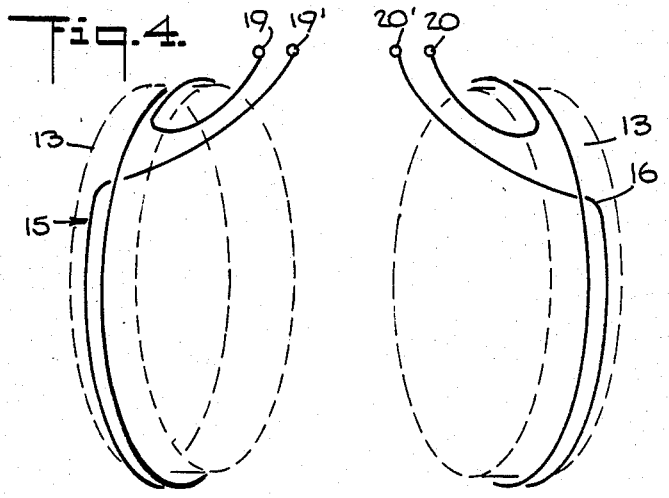
FIG. 4 is an illustrative arrangement for winding the coils on the sleeve in accordance with the invention.
Figure 3:
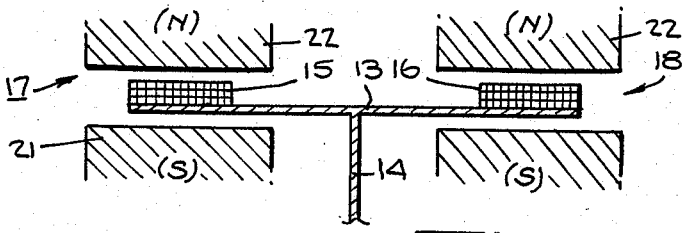
FIG. 3 is an enlarged view of the sleeve, coils and associated parts of the magnetic circuits of the transducer of FIG. 1.

As shown in FIGS. 2 and 3, an electromagnetic means is provided in the transducer 10 for reciprocating the sleeve 13 and diaphragm 14 in a linear manner in a direction transverse to the central plane of the sleeve 13 to produce a balanced sound. This means includes a pair of coils 15, 16 equally wound about and on the sleeve 13 in symmetrical relation to the diaphragm 14 and a pair of stationary magnetic circuits 17, 18 disposed in symmetrical relation about the diaphragm 14. The coils 15, 16 are equally wound on the sleeve 13 in fixed relation to effect equal and codirectional electromotive forces therein in response to an alternating current supplied to the coils 15, 16. As shown in FIG. 4, the equally wound coils 15, 16 are wound to achieve a mirror image symmetry with respect to one another. Only two windings are shown in each coil for purposes of clarifying the winding directions. Each coil 15, 16 has a pair of ends or leads 19, 19', 20, 20' which extend away from the sleeve 13 to a suitable common tap (not shown) in the frame 11. In addition, the current entering lead 19', 20' of each coil is located under the wound coil. The coils 15, 16 are energized in parallel by applying an electrical signal from a suitable common source (not shown) to the terminals 19, 19', 20, 20' at the tap (not shown). The symmetrical arrangement shown provides an equal distribution of incoming electrical current throughout each coil 15, 16.

In this embodiment, the current leads for the two coils are illustrated as being next to one another. Variations in the placement of leads 19, 19' with respect to leads 20, 20' will establish manufacturing methods and signal transformation requirements.

Referring to FIG. 2, the magnetic circuits 17, 18 are mounted in the frame 11 in spaced apart relation and are abutted against the flange 12. Each circuit 17, 18 includes a pair of concentric spaced apart pole rings 21, 22 disposed about a respective coil 15, 16. One pole ring 21 acts, e.g. as a South pole, while the other pole ring 22 acts as a North pole. In addition, each circuit 17, 18 has an annular magnet 23 secured to the outer pole ring 22, a transfer ring 24 secured to the inner pole ring 21 and an annular transfer plate 25 secured to the magnet 23 and transfer ring 24. As indicated, the transfer plate 25 forms a circular opening in communication with the diaphragm 14.

The pole rings 21, 22 define air gaps in which the sleeve 13 and respective coils 15, 16 are located and across which magnetic lines of flux flow. The magnetic flux thus flows via the magnet 23, transfer plate 25 and transfer ring 24 between the pole rings 21, 22. In this construction, the magnets 23, pole rings 21, 22 and flux transfer plates 25 are made of low loss magnetic material. The transfer rings 24 are made of cast iron.

A pair of resilient pads 26, for example of compressible fiber, are mounted between the pole rings 21 to center the diaphragm 14. These pads 26 are sufficiently resilient to avoid imparting a damping effect on the reciprocating motion of the diaphragm 14 during operation.

In operation, an electrical signal in the form of an alternating current is supplied to the terminals 19, 19', 20, 20' of the two coils 15, 16. The signal is then divided into two balanced currents which are passed through the two coils 15, 16. Magnetic flux lines are then developed in each coil 15, 16 and interact with the stationary lines of flux generated across the pole rings 21, 22. As a result, an electromotive force is created to move each coil 15, 16 and, thus, the sleeve 13. As these forces are co-directional, i.e. directed in the same direction, for example to the right as viewed in FIG. 2, the sleeve 13 and diaphragm 14 move to the right. As the current alternates, so does the direction of electromotive forces. Thus, the sleeve 13 and diaphragm 14 move to the left as viewed in FIG. 2. A linear reciprocating motion is thus effected in the diaphragm 14.

It is noted that the stationary magnetic field width and flux density is dependent on the size and width of each respective wound coil 15, 16.

In one embodiment, the inner pole ring 21 has an outside diameter of 3.593 inches while the outer pole ring 22 has an inner diameter of 3.625 inches to form an annular air gap of 0.032 inches. The sleeve 13 has an inner diameter of 3.607 inches while the coil 15, 16 has an outer diameter of 3.643 inches to give a clearance of 0.032 inches from the outer pole ring 22. The coils may be formed of wires of width of 0.003 inches and a height of 0.012 inches.

The use of two coils 15, 16 and two magnetic circuits 17, 18 for driving the diaphragm 14 results in a balanced movement. If a single magnetic circuit were used with the two coils 15, 16 or if two magnetic circuits 17, 18 were used with one symmetrically placed coil, there would be an imbalance of forces. This imbalance of forces, in turn, restricts the electrical current from generating motion to maximum potential. Further, the length of two equal and parallel coils 15, 16 compared to a single series conductor of equal total length reduces the time required for a current to travel their lengths. That is, the time is reduced by one-half. Thus, a transducer employing this parallel arrangement generates an increased efficiency relative to time.

The invention thus provides a transducer which, when used as a loudspeaker, can reciprocate a diaphragm in a balanced manner and, as such, can produce sound waves without distortion. As a result, less power is required to produce sound of a given intensity.

The transducer 10 may be provided with suitable gridlike diffuser covers at the open ends for diffusion of the produced sound waves. These covers can be secured in place in any known manner.

What is claimed is:

1. a transducer comprising
a sleeve;
a diaphragm secured to and within said sleeve in a central plane thereof; and
electromagnetic means disposed in mirror image symmetric relation to said sleeve for reciprocating said sleeve and diaphragm in a linear manner to produce a balanced distortion free sound.

2. A transducer as set forth in claim 1 wherein said means includes a pair of coils wound about said sleeve in mirror image symmetrical relation about said central plane, said coils being equally wound to effect equal and co-directional electromotive forces therein in response to an alternating current supplied to said coils, and means defining a pair of stationary magnetic circuits disposed in symmetrical relation about said central plane, each said magnetic circuit being disposed about a respective one of said coils.

3. A transducer as set forth in claim 1 wherein said diaphragm is a flat disc.

4. A transducer as set forth in claim 3 wherein said disc is made of metal.

5. A transducer as set forth in claim 2 which further comprises a frame having said magnetic circuit defining means mounted therein in stationary relation.

6. A transducer as set forth in claim 5 wherein each magnetic circuit includes a pair of concentric spaced apart pole rings having one end of said sleeve disposed concentrically therebetween.

7. A transducer as set forth in claim 6, wherein each magnetic circuit includes an annular magnet secured to one of said pole rings, a transfer ring secured to the other of said pole rings and an annular transfer plate secured to said magnet and said transfer ring, said transfer plate defining an opening in communication with said diaphragm.

8. A transducer as set forth in claim 6 which further comprises at least one resilient pad for centering said diaphragm relataive to said pole rings.

9. A transducer as set forth in claim 1 wherein said electromagnetic means is disposed to reciprocate said sleeve in a direction transverse to said plane.

10. A transducer as set forth in claim 9 wherein said electromagnetic means includes a pair of coils equally wound about and on said sleeve in mirror image symmetrical relation about said central plane for conducting an alternating current therethrough in parallel from a common source.

11. A transducer as set forth in claim 10 wherein said sleeve is flangeless.

12. A transducer comprising
a sleeve;
a diaphragm secured to and within said sleeve at a central plane thereof;
a first coil of wire wound about said sleeve on one side of said plane, said coil having a pair of ends extending away from said sleeve to conduct an alternating current through said coil to effect an electromotive force therein;
first means on said one side of said plane defining a magnetic circuit about said first coil;
a second coil of wire wound about said sleeve on an opposite side of said plane in mirror image symmetry to said first coil, said second coil having a pair of ends extending away from said sleeve to conduct an alternating current through said second coil to effect an electromotive force therein equal to and directed in the same direction as said electromotive force in said first coil;
second menas on said opposite side of said plane defining a second magnetic circuit about said second coil; and
a common source of alternating current connected to said first coil and said second coil.

13. An electroacoustic transducer apparatus for converting electrical energy to mechanical energy, said apparatus comprising
first and second magnetic circuits, each circuit having a permanent magnet and at least one magnetic flux translative element for producing an elongated annular air gap for conducting magnetic flux;
tubular sleeve means disposed in said gap between said magnet and said element of each magnetic circuit;
first and second coils mounted on respective ends of said tubular sleeve and wound in identical mirror image relation to one another for conducting an alternating current therethrough in parallel from a common source;
a diaphragm disposed within said tubular sleeve and midway between said first and second coils; and
a frame holding said first and second magnetic circuits in mirror image relationship with one another.

* * * * *

UNITED STATES PATENT AND TRADEMARK OFFICE

CERTIFICATE OF CORRECTION

PATENT NO. : 4,584,438

DATED : April 22, 1986

INVENTOR(S) : Erl Koenig

It is certified that error appears in the above-identified patent and that said Letters Patent is hereby corrected as shown below:

Column 1, line 19 change "form, will" to -form will-
Column 2, line 1 change "worthwile" to -worthwhile-
Column 3, line 32 change "mehanical" to -mechanical-
Column 3, line 56 change "configurtion" to -configuration-
Column 3, line 67 change "i.g." to -e.g.-
Column 5, line 18 change "of width" to -of a width-
Column 6, line 14 change "relataive" to -relative-
Column 6, line 44 change "menas" to -means-

Signed and Sealed this

Fourteenth Day of October, 1986

[SEAL]

*Attest:*

DONALD J. QUIGG

*Attesting Officer*

*Commissioner of Patents and Trademarks*